US006614209B1

(12) United States Patent
Gregoire, Jr.

(10) Patent No.: US 6,614,209 B1
(45) Date of Patent: Sep. 2, 2003

(54) MULTI STAGE CIRCUITS FOR PROVIDING A BANDGAP VOLTAGE REFERENCE LESS DEPENDENT ON OR INDEPENDENT OF A RESISTOR RATIO

(75) Inventor: Bernard Robert Gregoire, Jr., Pocatello, ID (US)

(73) Assignee: AMI Semiconductor, Inc., Pocatello, ID (US)

( * ) Notice: Subject to any disclaimer, the term of this patent is extended or adjusted under 35 U.S.C. 154(b) by 0 days.

(21) Appl. No.: 10/135,710

(22) Filed: Apr. 29, 2002

(51) Int. Cl.[7] ..... G05F 3/16
(52) U.S. Cl. ..... 323/316; 327/513; 327/539
(58) Field of Search ..... 323/313, 907, 323/314, 315, 316; 327/513, 538, 539

(56) References Cited

U.S. PATENT DOCUMENTS

| | | | | |
|---|---|---|---|---|
| 4,636,710 A | | 1/1987 | Stanojevic | 323/280 |
| 5,325,045 A | | 6/1994 | Sundby | 323/313 |
| 6,121,824 A | | 9/2000 | Opris | 327/539 |
| 6,137,341 A | * | 10/2000 | Friedman et al. | 327/513 |
| 6,259,307 B1 | * | 7/2001 | Aram | 327/513 |

OTHER PUBLICATIONS

A CMOS Temperature–Compensated Current Reference, Willy M. Sansen, Frank Opt Eynde and Michiel Steyaert, IEEE Journal of Solid–State Circuits, vol. 23, No. 3, Jun. 1988, pp. 821–824.

A CMOS Voltage Reference, Yannis P. Tsividis and Richard W. Ulmer, IEEE Journal of Solid–State Circuits, vol. SC–13, No. 6, Dec., 1978, pp. 774–8.

* cited by examiner

*Primary Examiner*—Shawn Riley
(74) *Attorney, Agent, or Firm*—Workman Nydegger & Seeley

(57) ABSTRACT

A bandgap voltage reference uses multiple PTAT voltage reference circuits (also called PTAT sources) coupled in series to generate a final PTAT voltage. A current-biased base-emitter region of a bipolar transistor is coupled between the final PTAT voltage and an output terminal of the bandgap voltage reference so as to add the base-emitter voltage to the final PTAT voltage to thereby generate a stable bandgap voltage reference. By using multiple PTAT voltage reference in series, the need for a resistor ratio is reduced (or even eliminated) thereby reducing the size of the resistors that generate the resistor ratio (or eliminate the need for the resistors entirely).

32 Claims, 6 Drawing Sheets

MULTI STAGE CIRCUITS FOR PROVIDING A BANDGAP VOLTAGE REFERENCE LESS DEPENDENT ON OR INDEPENDENT OF A RESISTOR RATIO

BACKGROUND OF THE INVENTION

1. The Field of the Invention

The present invention relates to the field of bandgap voltage reference circuits. In particular, the present invention relates to circuits and methods for providing a bandgap voltage reference less dependent on or independent of a resistor ratio.

2. The Prior State of the Art

The accuracy of circuits often depends on access to a stable bandgap voltage reference. Accordingly, numerous bandgap voltage reference circuits have been developed. Bandgap voltage reference circuits will also be referred to herein as "bandgap references." A traditional bandgap reference generates a bandgap voltage reference that is stable with temperature by summing a relatively small Proportional To Absolute Temperature (PTAT) voltage ($V_{PTAT}$) with a base-emitter voltage ($V_{BE}$) of a bipolar transistor to generate a bandgap reference voltage that is stable with temperature.

FIG. 1 schematically illustrates a conventional bandgap reference 100 in accordance with the prior art. The bandgap reference 100 includes a PTAT voltage generator 101 that generates the PTAT voltage $V_{PTAT}$. The PTAT voltage generator 101 is coupled to a bipolar transistor, which is in turn coupled to a current bias 103 as illustrated. The result is an output voltage $V_{OUT}$ that is equal to the sum of $V_{PTAT}$ and $V_{BE}$. The positive temperature drift of $V_{PTAT}$ largely compensates for the negative temperature drift of $V_{BE}$ thus resulting in the output voltage $V_{OUT}$ being relatively stable with temperature.

FIG. 2 illustrates a conventional PTAT voltage generator 200, which may be the PTAT voltage generator 101 of FIG. 1. The PTAT voltage generator 200 includes four equivalently-sized bipolar transistors 201 through 204 coupled together as shown, and having an emitter terminal coupled to a corresponding current source 211 through 214. The current sources 211 and 212 are "M" times the magnitude of the current sources 213 and 214. The emitter terminals of the bipolar transistors 202 and 203 are each coupled to an input of an operational amplifier 224. The output of the amplifier 224 is coupled to ground via a series of elements that includes a resistor 222 having a resistance $R_2$, a resistor 221 having a resistance $R_1$, and a bipolar transistor 223, as shown.

In the illustrated configuration, the voltage across the resistor 221, which will be referred to as $V_1$, is defined by the following Equation (1).

$$V_1=2U_T ln(M) \tag{1}$$

where,

M is equal to the current ratio between current sources 211 and 212 and current sources 213 and 214; and $U_T$ is often referred to as the "thermal voltage" and is equal to $$\frac{kT}{q}.$$

Note that k is Boltzmann's constant ($1.38\times10^{-23}$ Joules(J)/Kelvin(K) or $8.62\times10^{-5}$ electron volts (eV)/K), T is temperature in degrees Kelvin, and q is the magnitude of charge of an electron (1.60×10−19 Coulombs(C)). In addition, the voltage across both,resistors 221 and 222, which will be referred to as $V_{PTAT}$, is defined by the following Equation (2).

$$V_{PTAT} = \left(1 + \frac{R_1}{R_2}\right)2U_T\ln(M) \tag{2}$$

In order to compensate for the negative temperature drift of the bipolar transistor 102, the PTAT voltage generator 101 needs a PTAT voltage $V_{PTAT}$ of approximately $33\ln(2)U_T$. The resistor ratio $R_1/R_2$ of the PTAT voltage generator 200 may thus be adjusted so that the PTAT voltage $V_{PTAT}$ approximates $33\ln(2)U_T$. In the case of the design in FIG. 2 with the density ratio M being 100, the resistor ratio $R_{1/R2}$ would be approximately 1.48. Although there are a variety of circuits for providing a PTAT voltage, such circuits typically employ a resistor ratio in order to provide the needed level of positive temperature shift.

Resistors can often take up significant chip space. With integrated circuits becoming increasing compact and complex, there is an effort to reduce the size of circuitry where possible. Accordingly, what is desired are circuits and methods for providing a bandgap voltage reference in a more compact fashion.

SUMMARY OF THE INVENTION

The foregoing problems in the prior state of the art have been successfully overcome by the present invention, which is directed to circuits for providing a bandgap voltage reference that is less dependent on a resistor ratio. By reducing the dependency on the resistor ratio, the resistor ratio may be lowered thereby reducing the size of the resistors that generate the resistor ratio. In one embodiment, the dependency on a resistor ratio is eliminated completely, in which case there is not need for a resistor ratio at all.

Conventional bandgap voltage references use a single Proportional To Absolute Temperate (PTAT) source to generate a small PTAT voltage. That voltage is then added to a base-emitter voltage of a bipolar transistor to generate an accurate bandgap voltage. Conventional PTAT sources typically use a resistor ratio to generate the PTAT voltage. However, contrary to conventional technology, the principles of the present invention use more than one PTAT source coupled in series. The PTAT voltage generated by all previous PTAT sources in the series are added to the supplemental PTAT voltage generated by the next PTAT source in the series, and so forth, until the final PTAT voltage has been generated by the terminating PTAT source in the series.

One might think that the addition of supplemental PTAT sources might increase the size of the overall bandgap generation circuit. However, in many applications, the bandgap voltage references in accordance with the present invention may be made smaller when factoring in that the resistor ratio dependency is reduced or even eliminated.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The invention is described below by using diagrams to illustrate either the structure or processing of embodiments used to implement the circuits and methods of the present invention. Using the diagrams in this manner to present the invention should not be construed as limiting of the scope of the invention. Specific embodiments are described below in order to facilitate an understanding of the general principles of the present invention. Various modifications and variations will be apparent to one of ordinary skill in the art after having reviewed this disclosure.

Conventional bandgap voltage references use a single Proportional To Absolute Temperate (PTAT) generation circuit to generate a small PTAT voltage. That voltage is then added to a base-emitter voltage of a bipolar transistor to generate an accurate bandgap voltage reference. Conventional PTAT generation circuits typically use a resistor ratio to generate the PTAT voltage. However, contrary to conventional technology, the principles of the present invention use more than one PTAT source coupled in series such that the PTAT voltage generated by all previous PTAT source in the series are added to the supplemental PTAT voltage generated by the next PTAT source, and so forth, until the final PTAT voltage has been generated by the terminating PTAT source in the series.

Figure 1:
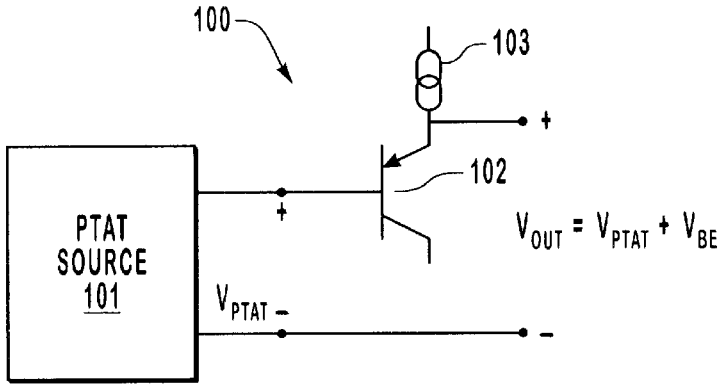
FIG. 1 (PRIOR ART)
FIG. 1 is a schematic circuit diagram of a conventional bandgap voltage reference circuit in accordance with the prior art.
Figure 2:
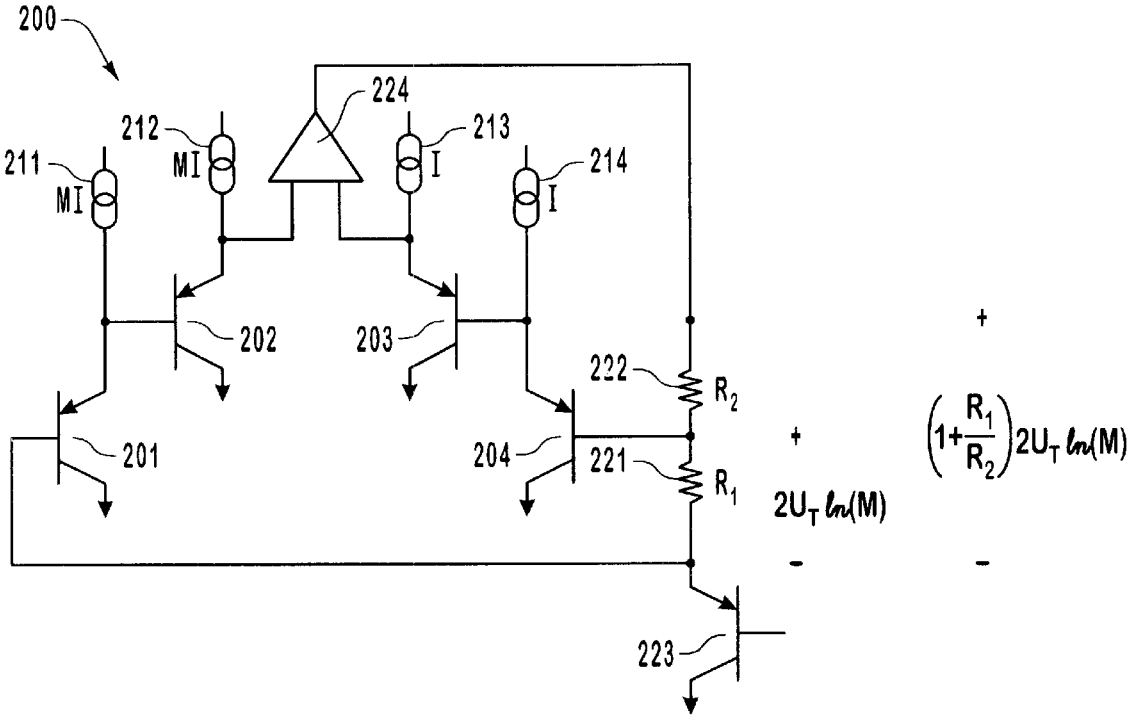
FIG. 2 (PRIOR ART)
FIG. 2 is a schematic circuit diagram of a circuit that generates a Proportional To Absolute Temperature (PTAT) voltage.
Figure 3:
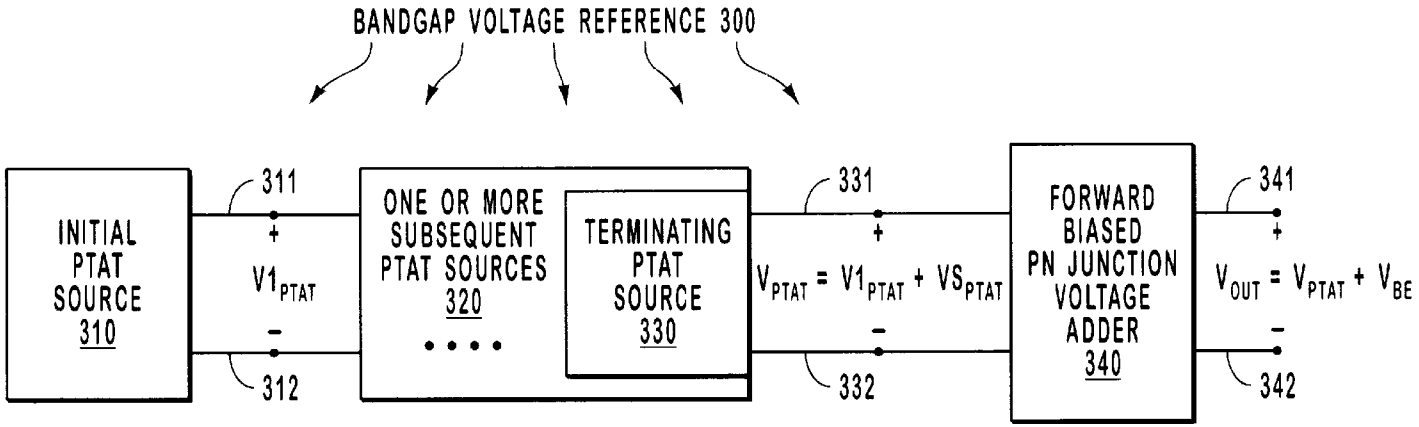
FIG. 3 schematically illustrates a bandgap reference in accordance with the present invention including an initial PTAT source and one or more subsequent PTAT sources that combine to generate a final PTAT voltage, which is added to a base-emitter voltage to generate a temperature stable bandgap reference voltage.

FIG. 3 schematically illustrates a bandgap voltage reference 300 in accordance with the present invention, which is configured to generate a bandgap voltage $V_{OUT}$ that is relatively stable with temperature. The bandgap voltage reference 300 includes an initial PTAT source 310 that is configured to generate an initial voltage (V1) across the output terminals 311 and 312 of the initial PTAT source 310. The initial voltage V1 has a PTAT component called herein an initial PTAT voltage ($V1_{PTAT}$) as well as potentially a non-temperature dependent voltage component.

Unlike conventional bandgap voltage references, the bandgap voltage reference 300 also includes one or more subsequent PTAT sources 320 that are coupled in series with the initial PTAT source 310 to complete a series of PTAT sources beginning with the initial PTAT source 310 and ending at a terminating PTAT source 330. The one or more subsequent PTAT sources 320 are configured to add a supplemental PTAT voltage ($VS_{PTAT}$) to the initial PTAT voltage ($V1_{PTAT}$) and are configured to substantially offset any non-temperature dependent voltage components introduced by the initial PTAT source 310 ) to generate a final PTAT voltage ($V_{PTAT}$) between the output terminals 331 and 332 of the terminating PTAT source 330.

More regarding the non-temperature dependent voltage component will be described with respect to the example bandgap voltage reference illustrated in FIG. 5. In this description and in the claims, PTAT sources "coupled in series" means that each PTAT source is configured to superimpose a supplemental PTAT voltage on the PTAT voltage generated by the previous PTAT source.

The bandgap voltage reference 300 also includes a forward biased PN junction voltage adder 340 that is configured to add a voltage roughly equal to the bandgap of the underlying material that forms the PN junction. In this description, that voltage will often be referred to as $V_{BE}$ since the embodiments illustrated herein form a forward biased PN junction for the adder 340 (as well as potentially other forward biased PN junctions) using the base-emitter junction of a bipolar transistor that has a bias current forced through its base-emitter junction. The adder 340 adds the junction voltage $V_{BE}$ to the final PTAT voltage ($V_{PTAT}$) to generate a bandgap voltage ($V_{OUT}$) at the output terminals 341 and 342 of the bandgap voltage reference 300. The final PTAT voltage $V_{PTAT}$ has a positive temperature drift that roughly offsets the negative temperature drift of the junction voltage $V_{BE}$. Although the forward biased PN junction voltage adder 340 is illustrates as occurring after the terminating PTAT source 330 in FIG. 3, the forward biased PN junction voltage adder may be incorporated within the initial PTAT source 310 or within the one or more subsequent PTAT sources 320. An example of this is described below with respect to FIG. 7.

Figure 4B:
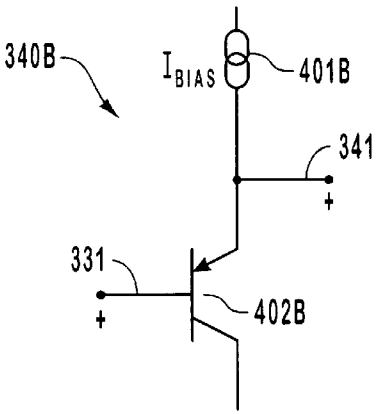
FIG. 4B illustrates another example of the base-emitter voltage adder of FIG. 3 in further detail.
Figure 4A:
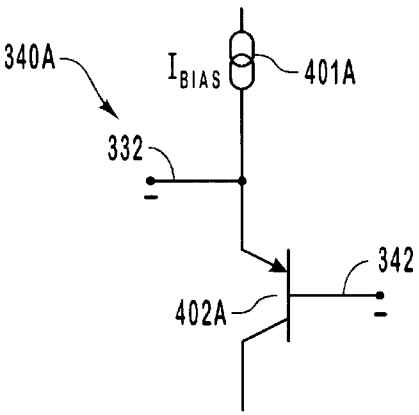
FIG. 4A illustrates one example of the base-emitter voltage adder of FIG. 3 in further detail.

FIG. 4A illustrates an example 340A of the forward biased PN junction voltage adder 340 of FIG. 3 in further detail. In particular, the negative output terminal 332 of the terminating PTAT source 330 is connected to the emitter terminal of a PNP bipolar transistor 402 A. The base terminal of the bipolar transistor 402A is connected to the negative output terminal 342 of the bandgap voltage reference 300. A bias current source 401A forces a bias current $I_{BIAS}$ through the base-emitter junction of the bipolar transistor 402A. This results in the voltage at the negative output terminal 342 of the bandgap voltage reference 300 being lower than the voltage of negative output terminal 332 of the terminating PTAT source 330 by an amount equal to $V_{BE}$ thereby adding the voltage $V_{BE}$ to the final PTAT voltage $V_{PTAT}$.

FIG. 4B illustrates another example 340B of the forward biased PN junction voltage adder 340 of FIG. 3 in further detail. In particular, the positive output terminal 331 of the terminating PTAT source 330 is connected to the base terminal of a PNP bipolar transistor 402B. The emitter terminal of the bipolar transistor 402B is connected to the positive output terminal 341 of the bandgap voltage reference 300. A bias current source 401B forces a bias current $I_{BIAS}$ through the base-emitter junction of the bipolar transistor 402B. This results in the voltage at the positive output terminal 341 of the bandgap voltage reference 300 being greater than the voltage of positive output terminal 331 of the terminating PTAT source 330 by an amount equal to $V_{BE}$ thereby adding the voltage $V_{BE}$ to the final PTAT voltage $V_{PTAT}$.

Although specific examples of a forward biased PN junction voltage adder 340 have been described with respect to FIG. 4A and FIG. 4B, those of ordinary skill in the art will recognize that there is a wide variety of equivalent circuits that are configured to add a forward biased PN junction voltage to a PTAT voltage $V_{PTAT}$. Accordingly, the present invention is not limited to the illustrated examples in FIG. 4A and FIG. 4B.

There are also a wide variety of different types of possible PTAT sources. The following describes various examples of bandgap voltage references in accordance with the present invention with respect to FIG. 5 through FIG. 10. In those figures, each PTAT source is illustrated as being enclosed within a dashed box for clarity, except for the terminating PTAT source, which is enclosed with a dotted box. Also, the one or more subsequent PTAT sources as a whole are enclosed with an intermitted dashed/dotted box. Also in those figures, examples of particular elements illustrated in FIG. 3 are numbered in increments of 100 over the numbering of the corresponding element in FIG. 3. For example, the initial PTAT source is numbered 310 in FIG. 3. An example of the PTAT source in FIG. 5 is numbered 510, a difference of 200. Similar nomenclature and numbering is used consistently throughout this description.

Figure 5:
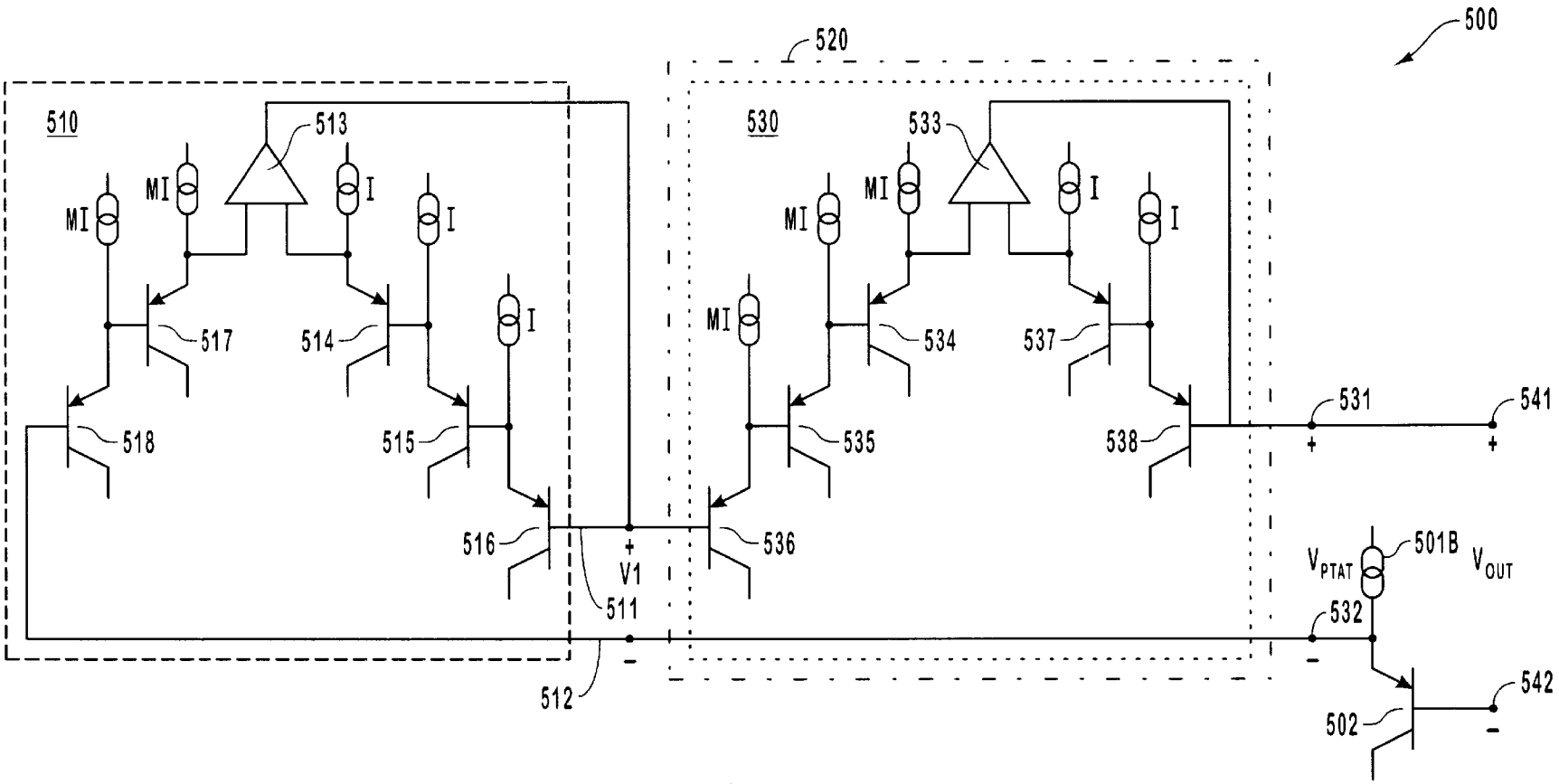
FIG. 5 illustrates a two stage bandgap voltage reference that lacks a resistor ratio in accordance with a first embodiment of the present invention.

FIG. 5 illustrates an example bandgap voltage reference 500 in accordance with the present invention, which includes an initial PTAT source, and in which the one or more subsequent PTAT sources 520 includes just the terminating PTAT source 530. The initial PTAT source 510 includes an operational amplifier 513 that has an output terminal that is connected to the output terminal 511 of the initial PTAT source 510 (which is also an input terminal to the terminating PTAT source 530). Likewise, the terminating PTAT source 530 includes an operational amplifier 533 that has an output terminal that is connected to the output terminal 531 of the terminating PTAT source 530.

Note that the input terminals of each of the operational amplifiers are coupled to a series of forward biased PN junctions in the form of current biased base-emitter junctions of PNP bipolar transistors. Referring to the initial PTAT source 510, the right input terminal of the operational amplifier 513 is coupled to the positive output terminal 511 of the initial PTAT source 510 via a series of three base-emitter regions, one for each of bipolar transistors 514, 515 and 516, each bipolar transistor having a current I forced through its base-emitter junction. The left input terminal of the operational amplifier 513 is coupled to the negative output terminal 512 of the initial PTAT source 510 via a series of two base-emitter regions, one for each of bipolar transistors 517 and 518, each bipolar transistor having a current MI forced through its base-emitter junction, where M is a value greater than 1. In one example, the operational amplifier 513 operates to keep the voltage at each of its input terminals substantially the same. However, to reduce the number of stages needed to generate a particular PTAT voltage, the operational amplifiers may also have a designed intentional temperature dependent offset voltage built in. To accomplish temperature dependent offset voltages in the operational amplifier, the input differential pairs may operate at different current densities to thereby generate the temperature dependent offset as is known to one of ordinary skill in the art.

In evaluating the upper branch of the bandgap voltage reference 500, we traverse up two bipolar transistors biased with current MI, through the operational amplifier 513, down three bipolar transistors biased with current I, up three bipolar transistor biased with current MI, through operational amplifier 533, and down two bipolar transistors biased with current I. Along this path, any time the number of transistors with current MI traversed going up is equal to the number of transistors with current I going down, the voltage relative to the negative output terminals 512 and 532 is a PTAT voltage equal to $U_T\ln(M)$ times the number of bipolar transistors with current MI that were traversed to that point. Note that $U_T$ is the thermal voltage which is equal to kT/q, where k is Botzmann's constant, q is a constant equal to the charge of an electron, and T is absolute temperature in degrees Kelvin. It follows that thermal voltage is proportional to absolute temperature and, since M is also a constant, it follows that $U_T\ln(M)$ is also proportional to absolute temperature.

The initial PTAT source 510 has a component that generates an initial PTAT voltage. In particular, consider the base terminal of the bipolar transistor 515. Upon until that point moving from left to right in the upper branch, two bipolar transistors with current MI have been traversed (namely bipolar transistors 518 and 517 ), as well as two bipolar transistors with current I (namely bipolar transistors 514 and 515 ). Accordingly, the voltage between the base terminal of the bipolar transistor 515 and the negative output terminal 512 of the initial PTAT source is equal to 2 $U_T\ln(M)$, which is a voltage that is proportional to absolute temperature.

However, the base-emitter voltage of the bipolar transistor 516 is subtracted from this PTAT voltage to generate an initial voltage V1 that has a PTAT voltage component as well as a "non-PTAT" voltage component (or a voltage component that is not proportional to absolute temperature).

Referring to the terminating PTAT source 530, the left input terminal of the operational amplifier 533 is coupled to the positive output terminal 511 of the initial PTAT source 510 via a series of three base-emitter regions, one for each of bipolar transistors 534, 535 and 536, each bipolar transistor having a current MI forced through its base-emitter junction. The right input terminal of the operational amplifier 533 is coupled to the positive output terminal 531 of the terminating PTAT source 530 via a series of two base-emitter regions, one for each of bipolar transistors 537 and 538, each bipolar transistor having a current I forced through its base-emitter junction. The operational amplifier 533 operates to keep the voltage at each of its input terminals substantially the same.

The terminating PTAT source 510 is configured to add a supplemental PTAT voltage to the initial PTAT voltage, and is also configured to offset any non-PTAT voltage present in the initial voltage. In particular, the emitter terminal of the bipolar transistor 536 has a voltage relative to the negative output terminal 532 equal to 3 $U_T\ln(M)$. Accordingly, at that emitter terminal, the non-PTAT voltage component has already been eliminated. This is because when we move from left to right in the upper branch, three bipolar transistors with current MI (specifically, bipolar transistors 518, 517 and 536 ) have been traversed, as well as three bipolar transistors with current I (specifically 514, 515 and 516 ).

At the positive output terminal 531, moving from left to right, five bipolar transistors with current MI have been traversed in addition to five bipolar transistors with current I. Thus, the PTAT voltage $V_{PTAT}$ applied between the two output terminals 531 and 532 of the terminating PTAT source 530 is equal to 5 $U_T\ln(M)$. In order to compensate from the negative temperature drift of a forward biased PN junction, the final PTAT voltage $V_{PTAT}$ needs to be approximately $33\ln(2)U_T$ or approximately $22.9U_T$. A value M of 100 produces a PTAT voltage of $5U_T\ln(100)$ or $23.0U_T$. Accordingly, the initial PTAT source 510 along with the terminating PTAT source 530 generate a PTAT voltage that is substantially what is needed to offset the negative temperature drift of a subsequent forward biased PN junction.

Accordingly, the current-biased transistor 502 adds a voltage appropriate to generate a relatively temperature stable bandgap voltage across the output terminals 541 and 542 of the bandgap voltage reference 500, even without having used a resistor ratio. Accordingly, the size of the overall bandgap voltage reference may be significantly reduced as compared to conventional bandgap voltage references that have resistor ratios. This is true despite the presence of more than one operational amplifier since each operational amplifier may be a fraction of the size of the single operational amplifier present in the conventional bandgap voltage reference.

Furthermore, the current bias for the bipolar transistors may be generated by a Metal Oxide Silicon Field Effect Transistor (MOSFET) operating in saturation mode, as opposed to having a current source composed of resistors. Accordingly, the bandgap voltage reference 500 may be constructed without resistors at all, thus resulting in significant size savings. The use of MOSFETs is further advantageous because MOSFETs operating in saturation mode typically provide a more stable current given process fluctuations than do resistors.

While FIG. 5 and the corresponding discussion disclose one particular embodiment of a bandgap voltage reference in accordance with the present invention, there are many other embodiments of the present invention that will be understood to be within the scope of the present invention by one or ordinary skill in the art after having reviewed this description. A few additional embodiments of the present invention will be described in order to demonstrate the flexible nature of the principles of the present invention.

Figure 6:
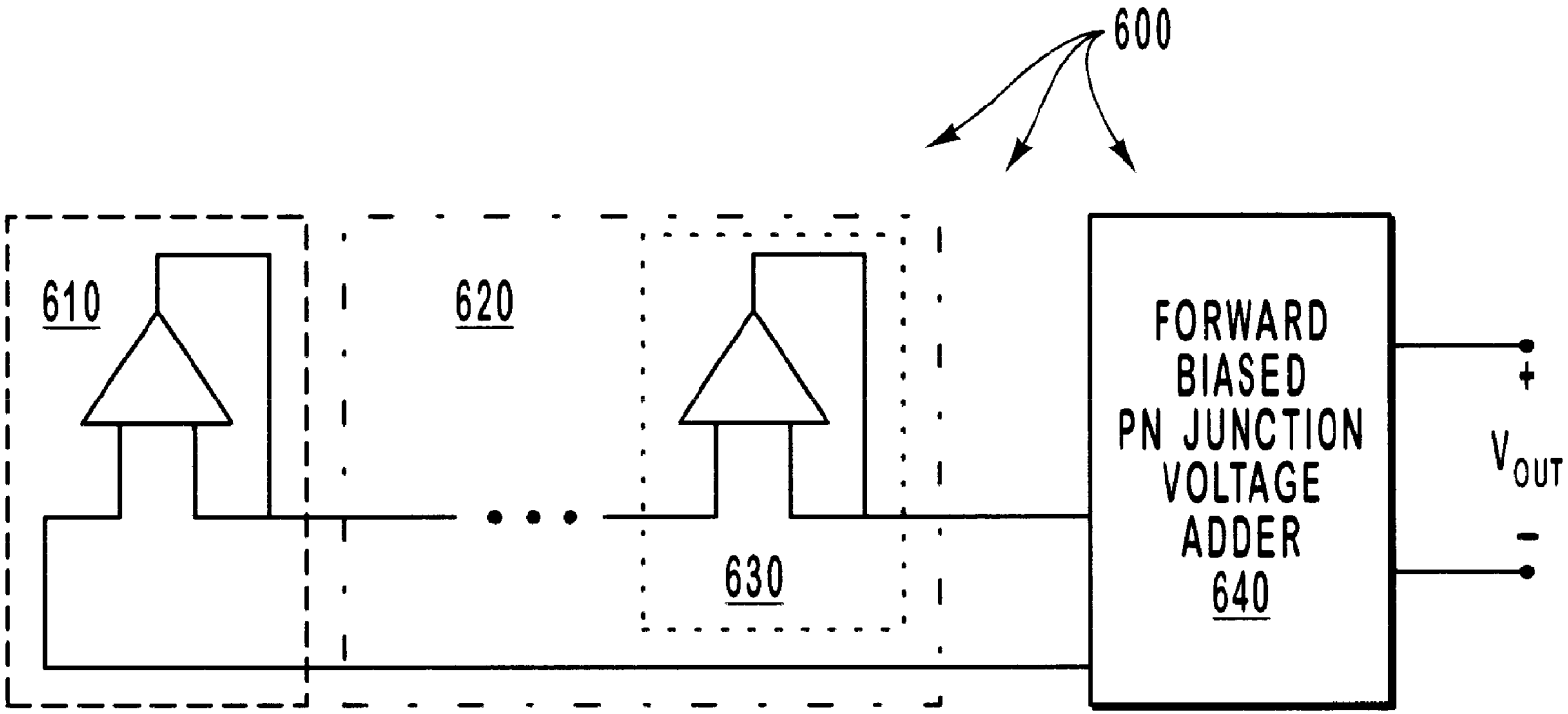
FIG. 6 illustrates a multiple stage bandgap voltage reference that lacks a resistor ration and which uses amplifiers with a built in PTAT offset in accordance with a second embodiment of the present invention.

For example, FIG. 6 illustrates a multistage bandgap voltage reference 600 in accordance with a second embodiment of the present invention. The bandgap voltage reference 600 has multiple PTAT sources in series including an initial PTAT source 610, and one or more subsequent PTAT sources 620 that include the terminating PTAT source 630 among other PTAT sources. Each PTAT source includes a specialized operational amplifier that introduces a PTAT voltage even without the assistance of intervening transistors between operational amplifiers. There are horizontal ellipses shown in the one or more subsequent PTAT sources 620 to illustrate that as many operational amplifiers may be added to the series as is needed to generate the appropriate magnitude of PTAT voltage.

Figure 7:
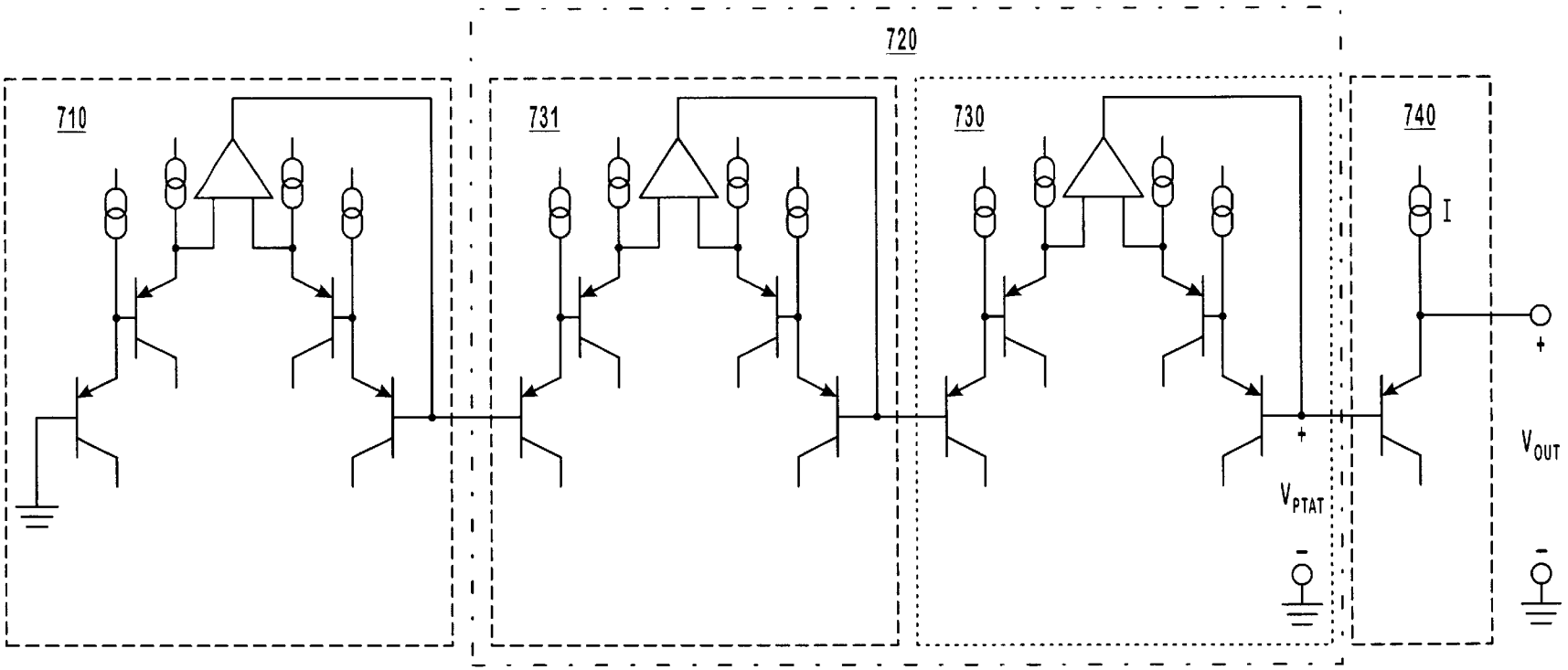
FIG. 7 illustrates a three stage bandgap voltage reference that lacks a resistor ratio and that is suitable for power supplies as low as 2.5 volts in accordance with a third embodiment of the present invention.

FIG. 7 illustrates a bandgap voltage reference 700 in accordance with a third embodiment of the present invention. This bandgap voltage reference 700 is suitable for low voltage application since the inputs to the operational amplifier are only at approximately twice the bandgap voltage. A 2.5 volt supply voltage is sufficient to provide a stable bias current to this node assuming the circuit substrate is silicon. As illustrated, the current-biased bipolar transistor in the stage 740 represents an example of the forward biased PN junction voltage adder 340 of FIG. 3. However, the forward biased PN junction adder 340 may be incorporated within the one or more subsequent PTAT sources 320 as previously mentioned. With respect to FIG. 7, this may be accomplished by removing the bipolar transistor in stage 740, and by removing the right-most bipolar transistor in stage 730 to thereby effectively add a forward biased PN junction voltage within the terminating stage 730 itself.

Figure 8:
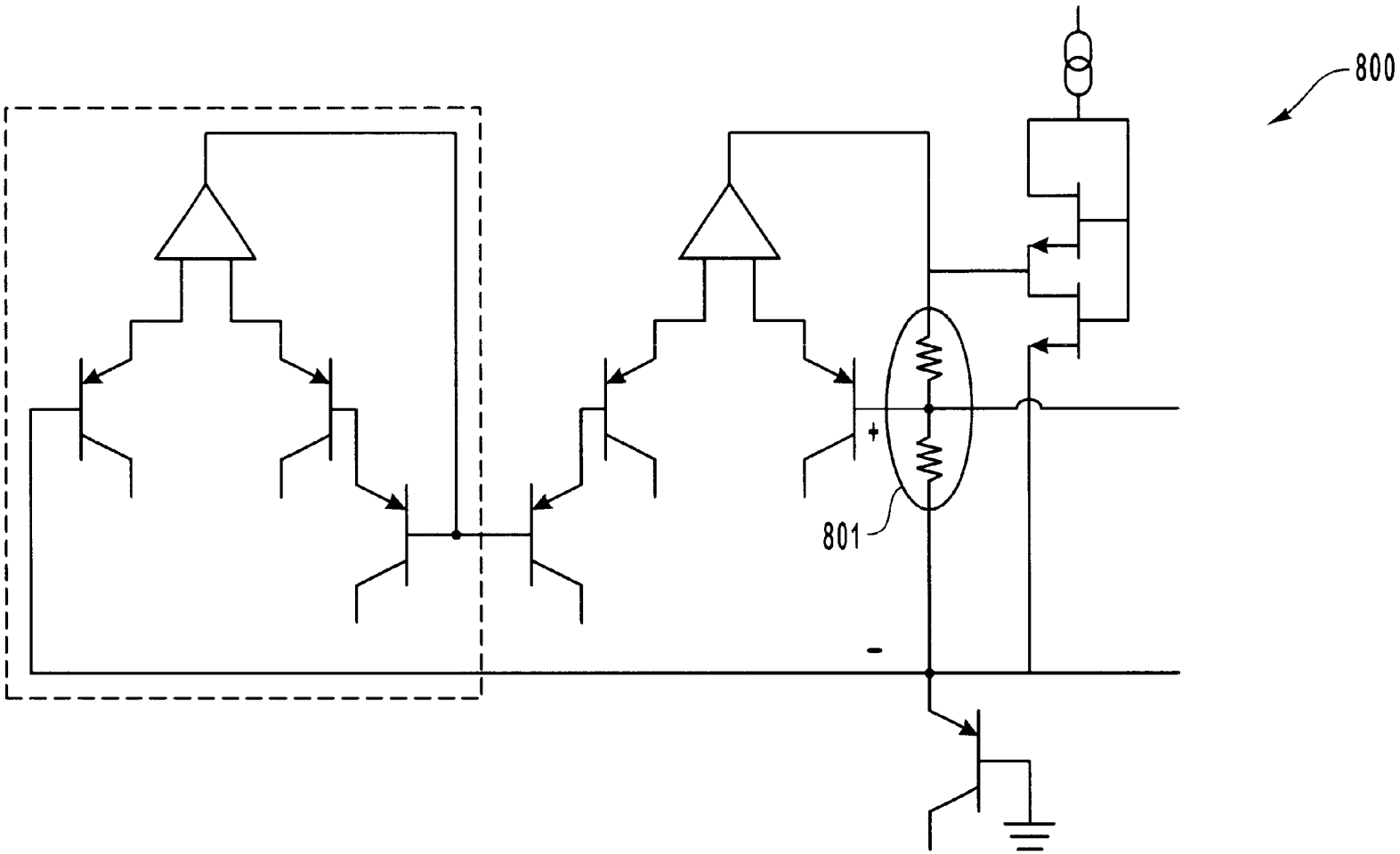
FIG. 8 illustrates a two stage bandgap voltage reference that uses a reduced resistor ration in accordance with a fourth embodiment of the present invention.

FIG. 8 illustrates a bandgap voltage reference 800 in accordance with a fourth embodiment of the present invention. The bandgap voltage reference 800 does have resistors 801 that make up a resistor ratio. However, the resistor ratio is significantly lowered as compared to the resistor ratio in conventional bandgap voltage references. Accordingly, the size of the resistor combination that composes the resistor ratio may be reduced. Accordingly, the present invention may be used to provide multiple PTAT source not just to eliminate a resistor ratio, but also to reduce a resistor ratio as well.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A bandgap voltage reference circuit having at least two output terminals, the bandgap voltage reference circuit configured to apply a bandgap voltage between the two output terminals during operation, the bandgap voltage reference circuit comprising the following:

an initial Proportional To Absolute Temperature (PTAT) source having two output terminals, the initial PTAT source configured to generate an initial voltage across the two output terminals of the initial PTAT source, the initial voltage containing an initial PTAT voltage as well as potentially a non-PTAT voltage component;

one or more subsequent PTAT sources coupled in series with the initial PTAT source to complete a series of PTAT sources beginning with the initial PTAT source and ending at a terminating PTAT source of the one or more subsequent PTAT sources, the one or more subsequent PTAT sources configured to add a supplemental PTAT voltage to the initial PTAT voltage and configured to substantially offset any non-PTAT voltage component present in the initial voltage to generate a final PTAT voltage between two output terminals of the terminating PTAT source; and a forward biased PN junction coupled in series between one of the two output terminals of the terminating PTAT source and one of the two output terminals of the bandgap voltage reference circuit.

2. A bandgap voltage reference in accordance with claim 1, wherein the initial PTAT source generates the initial voltage with just the initial PTAT voltage without the non-temperature dependent voltage component.

3. A bandgap voltage reference in accordance with claim 1, wherein the initial PTAT source generates the initial voltage with the initial PTAT voltage as well as the non-temperature dependent voltage component.

4. A bandgap voltage reference in accordance with claim 3, wherein the initial PTAT source includes a circuit component that generates the initial PTAT voltage as well as a circuit component that generates the non-temperature dependent voltage component.

5. A bandgap voltage reference in accordance with claim 4, wherein the one or more subsequent PTAT sources includes a circuit component that generates a PTAT voltage to add to the initial PTAT voltage, as well as a circuit component that substantially compensates for the non-temperature dependent voltage component in the initial voltage generated by the initial PTAT source.

6. A bandgap voltage reference in accordance with claim 5, wherein at least one PTAT source of the combination of the initial PTAT source and the one or more subsequent PTAT voltage sources comprise an operational amplifier.

7. A bandgap voltage reference in accordance with claim 5, wherein a plurality of PTAT sources of the combination of the initial PTAT source and the one or more subsequent PTAT voltage sources comprise an operational amplifier.

8. A bandgap voltage reference in accordance with claim 5, wherein each PTAT source of the combination of the initial PTAT source and the one or more subsequent PTAT voltage sources comprise an operational amplifier.

9. A bandgap voltage reference in accordance with claim 1, wherein at least one PTAT source of the combination of the initial PTAT source and the one or more subsequent PTAT voltage sources comprises an operational amplifier.

10. A bandgap voltage reference in accordance with claim 1, wherein a plurality of PTAT sources of the combination of the initial PTAT source and the one or more subsequent PTAT voltage sources comprise an operational amplifier.

11. A bandgap voltage reference in accordance with claim 1, wherein each PTAT source of the combination of the initial PTAT source and the one or more subsequent PTAT voltage sources comprise an operational amplifier.

12. A bandgap voltage reference in accordance with claim 11, wherein each operational amplifier has an output terminal that is connected to the next PTAT source in the series of PTAT sources, except for the terminating PTAT source, whose operational amplifier has an output terminal connected to one of the output terminals of the terminating PTAT source.

13. A bandgap voltage reference in accordance with claim 12, wherein an input terminal of the operational amplifier of each of the PTAT sources in the series of PTAT sources is coupled to an input terminal of the operational amplifier of the next PTAT source in the series of PTAT sources, except for the terminating PTAT source, whose operational amplifier has an input terminal that is coupled to the same output terminal of the terminating PTAT source as the output terminal of the operational amplifier of the terminating PTAT source is connected to.

14. A bandgap voltage reference in accordance with claim 13, where an input terminal of the operational amplifier of each of the PTAT sources in the series of PTAT sources is directly connected to an input terminal of the operational amplifier of the next PTAT source in the series of PTAT sources, except for the terminating PTAT source, whose operational amplifier has an input terminal that is directly connected to the same output terminal of the terminating PTAT source as the output terminal of the operational amplifier of the terminating PTAT source is connected to.

15. A bandgap voltage reference in accordance with claim 13, where an input terminal of the operational amplifier of each of the PTAT sources in the series of PTAT sources is indirectly connected to an input terminal of the operational amplifier of the next PTAT source in the series of PTAT sources via a plurality of forward biased PN junctions, except for the terminating PTAT source, whose operational amplifier has an input terminal that is indirectly coupled to the same output terminal of the terminating PTAT source-as the output terminal of the operational amplifier of the terminating PTAT source is connected to via at least one forward biased PN junction.

16. A bandgap voltage reference in accordance with claim 15, wherein each of the forward biased PN junctions comprises the base-emitter terminal of a PNP bipolar transistor that has a bias current forced through its base-emitter junction.

17. A bandgap voltage reference in accordance with claim 13, wherein the output terminal of the operational amplifier of the terminating PTAT source is connected to an output terminal of the terminating PTAT source via a first resistor.

18. A bandgap voltage reference in accordance with claim 17, wherein the output terminals of the terminating PTAT source are coupled together via a second resistor.

19. A bandgap voltage reference in accordance with claim 13, wherein the output terminal of the operational amplifier of the terminating PTAT source is connected to an output terminal of the terminating PTAT source, but not via a resistor.

20. A bandgap voltage reference in accordance with claim 19, wherein the two output terminals of the terminating PTAT source are not connected, neither directly nor via a resistor, wherein the bandgap voltage reference does not employ a resistor ratio.

21. A bandgap voltage reference in accordance with claim 1, wherein the one or more subsequent PTAT sources is only the terminating PTAT source.

22. A bandgap voltage reference in accordance with claim 21, wherein the initial PTAT source and the terminating PTAT source each have an operational amplifier.

23. A bandgap voltage reference circuit in accordance with claim 22, wherein the output terminal of the operational amplifier of the terminating PTAT source is connected to one of the output terminals of the terminating PTAT source.

24. A bandgap voltage reference in accordance with claim 23, wherein an input terminal of the operational amplifier of the terminating PTAT source is coupled to the same output terminal of the terminating PTAT source as the output terminal of the operational amplifier of the terminating PTAT source is connected to.

25. A bandgap voltage reference in accordance with claim 24, wherein an input terminal of the operational amplifier of the terminating PTAT source is directly connected to the same output terminal of the terminating PTAT source as the output terminal of the operational amplifier of the terminating PTAT source is connected to.

26. A bandgap voltage reference in accordance with claim 24, wherein an input terminal of the operational amplifier of the terminating PTAT source is indirectly coupled to the same output terminal of the terminating PTAT source as the output terminal of the operational amplifier of the terminating PTAT source is connected to via one or more forward biased PN junctions.

27. A bandgap voltage reference in accordance with claim 26, wherein the one or more forward biased PN junctions each comprise the base-emitter region of a PNP bipolar transistor with a bias current forced through its base-emitter junction.

28. A bandgap voltage reference in accordance with claim 26, wherein the operational amplifier of the initial PTAT source has an input terminal that is indirectly coupled to the other output terminal of the terminating PTAT source via one or more forward biased PN junctions.

29. A bandgap voltage reference in accordance with claim 28, wherein the operational amplifier of the initial PTAT source has an input terminal that is indirectly coupled to the other output terminal of the terminating PTAT source via the base-emitter regions of one or more bipolar transistors that have a bias current forced through its base-emitter junction.

30. A bandgap voltage reference in accordance with claim 28, wherein an input terminal of the operational amplifier of the initial PTAT source is indirectly coupled to an input terminal of the operational amplifier of the terminating PTAT source via a plurality of forward biased PN junctions.

31. A bandgap voltage reference in accordance with claim 30, wherein the plurality of forward biased PN junctions each comprise the base-emitter regions of a bipolar transistor with a bias current forced through its base-emitter junction.

32. A method for generating a bandgap reference voltage comprising the following:

an act of generating an initial PTAT voltage;

an act of superimposing a subsequent PTAT voltage on the initial PTAT voltage to generate a final PTAT voltage; and an act of adding a base-emitter voltage of a bipolar transistor to the final PTAT voltage to generate the bandgap reference voltage.

* * * * *

UNITED STATES PATENT AND TRADEMARK OFFICE

CERTIFICATE OF CORRECTION

PATENT NO. : 6,614,209 B1
DATED : September 2, 2003
INVENTOR(S) : Bernard Robert Gregoire, Jr.

It is certified that error appears in the above-identified patent and that said Letters Patent is hereby corrected as shown below:

Column 2,
Line 8, after "electron" replace "(1.60x10-19" with -- (1.60x$10^{-19}$ --
Line 9, replace "both,resistors" with -- both resistors --
Line 29, replace "increasing" with -- increasingly --

Column 4,
Line 10, after "PTAT" replace "source" with -- sources --
Line 34, after "PTAT source" replace "310 )" with -- 310 --
Line 60, replace "is illustrates" with -- is illustrated --

Column 6,
Line 28, before "biased with current MI," replace "transistor" with -- transistors --
Line 45, after "Upon" remove "until"

Column 7,
Line 61, before "ordinary" replace "or" with -- of --

Column 8,
Line 37, after "multiple PTAT" replace "source" with -- sources --

Column 10,
Line 22, replace "source-as" with -- source as --

Signed and Sealed this

Sixth Day of April, 2004

JON W. DUDAS
*Acting Director of the United States Patent and Trademark Office*